US006499833B2

(12) United States Patent
Sugioka

(10) Patent No.: US 6,499,833 B2
(45) Date of Patent: Dec. 31, 2002

(54) INK JET RECORDING HEAD AND INK JET RECORDING APPARATUS

(75) Inventor: Hideyuki Sugioka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/917,692

(22) Filed: Jul. 31, 2001

(65) Prior Publication Data

US 2002/0024561 A1 Feb. 28, 2002

(30) Foreign Application Priority Data

Aug. 4, 2000 (JP) ..... 2000-236889

(51) Int. Cl.[7] ..... B41J 2/05
(52) U.S. Cl. ..... 347/57
(58) Field of Search ..... 347/10, 11, 53, 347/58, 94, 59, 57

(56) References Cited

U.S. PATENT DOCUMENTS 5,251,040 A * 10/1993 Saito ..... 358/298

FOREIGN PATENT DOCUMENTS

| | | | |
|---|---|---|---|
| EP | 0 995 600 | 4/1999 | |
| JP | 57-36679 | 2/1982 | |
| JP | 357182452 | * 11/1982 | ..... 347/71 |
| JP | 62-201254 | 9/1987 | |
| JP | 64-20150 | 1/1989 | |
| JP | 64-20152 | 1/1989 | |
| JP | 8-15629 | 1/1996 | |

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

An ink jet recording head and an ink jet recording apparatus which can be manufactured at low cost and with a continuous length by using nonlinear elements having MIM-type electrical characteristics to drive heat generating members having a bubble jet recording system so as to prevent the nonlinear elements from being destroyed by a heat generation of the nonlinear elements.

12 Claims, 7 Drawing Sheets

INK JET RECORDING HEAD AND INK JET RECORDING APPARATUS

BACKGROUND OF THE INVENTION

1. Field of the Invention

The present invention relates to an ink jet recording head and an ink jet recording apparatus for use in an ink jet printer, and particularly to those in a bubble jet recording method in which a bubbling phenomenon is used.

2. Description of the Related Art

An ink jet recording head in a bubble jet recording method generally comprises fine discharge ports, flow paths, and heat generating members provided in a part of the flow paths. In a bubble jet recording method, bubbles are generated by locally increasing a temperature of a liquid in a flow path using a heat generating member, the liquid is extruded from a fine discharge port by utilizing a high pressure at the bubbling, and then droplets of the liquid are deposited to a recording sheet or the like.

To obtain a finer image recorded in this bubble jet recording method, there is a need for a technology of discharging fine droplets at a high density. Therefore, it is particularly important to form fine flow paths and fine heat generating members. Accordingly, there has been suggested a method of manufacturing a head which enables a high-density arrangement by making the most of the photolithography technology with utilizing simplicity of a structure of the bubble jet recording system (for example, Japanese Patent Application Laid-Open No. 08-15629). In addition, to adjust a discharge amount of droplets, there has been suggested a heat generating member having a large heat release value in its central portion in comparison with its end portions (Japanese Patent Application Laid-Open No. 62-201254).

As a heat generating member, generally is used a tantalum nitride thin-film resistor having a thickness of approximately 0.05 $\mu$m and a Joule heat at energizing it is used to bubble the liquid. This kind of heat generating resistor is generally provided with a cavitation resistive layer made of a metal such as Ta having a thickness of approximately 0.2 $\mu$m through an insulating layer such as SiN having a thickness of approximately 0.8 $\mu$m to prevent a surface of the heat generating resistor from being damaged by a cavitation.

Furthermore, in Japanese Patent Application Laid-Open No. 64-20150, there is disclosed a multi-nozzle ink jet head wherein a plurality of vertical wires and a plurality of horizontal wires are arranged on a PC board and intersections of the both are provided with rectifying elements into which only forward current flows and heating elements connected thereto. In addition, in Japanese Patent Application Laid-Open No. 57-36679, there is disclosed a thermal head having a PC board on which there are a plurality of diodes arranged in arrays which enables a heat generation by energizing in the forward direction.

SUMMARY OF THE INVENTION

In a lot of conventional ink jet recording heads, heating elements, diodes, and logic circuit portions are fabricated at a time on a silicon base by a semiconductor process (ion implantation or other method). Therefore, a head having a relatively small number of nozzles can be compact in size, thereby enabling the fabrication in a single process advantageously. However, a full-line multi-head having a length of a full sheet width, for example, requires a length of approximately 12 inches (about 30 cm) and therefore an attempt of integrally assembling it may increase a cost since it is hard to use a normal silicon wafer.

Accordingly, if the heating elements for the bubble jet recording arranged in a matrix can be selectively driven by using nonlinear elements which can be generated without a use of the conventional semiconductor process such as the ion implantation method, it may be possible to provide a continuous ink jet recording head at a low cost.

Conventionally, MIM elements or the like which are nonlinear elements are used for liquid crystal devices. If the MIM elements are used for a liquid crystal device, a normal power density is approximately 1 W/m$^2$. On the other hand, approximately 0.1 GW/m$^2$ or higher power density need be treated for a heat generating member of a bubble jet recording head. Therefore, when an attempt is made to use the MIM elements as heat generating members of the bubble jet recording head, conventionally much more power need be supplied to resistive elements connected in series to the MIM elements, in comparison with the power used for the liquid crystal device. To solve this problem, it is possible to increase the power that can be supplied to the MIM elements to some extent by increasing a voltage applied to the MIM elements. There is, however, a fear of causing the MIM elements to be destroyed by a temperature rise of the MIM elements due to a heat generation thereof. There is no problem in this heat generation of the MIM elements in the conventional configuration in which the MIM elements are assumed to be nonlinear elements for matrix driving such as a case where the MIM elements are used for a liquid crystal device, while, if the MIM elements are used as nonlinear elements for matrix driving of heat generating members of a bubble jet recording apparatus, there is a fear of causing the MIM elements to be destroyed by the heat generation of the MIM elements as its own peculiar problem.

Therefore it is an object of the present invention to provide an ink jet recording head and an ink jet recording apparatus which can be manufactured at low cost and with a continuous length by using nonlinear elements having MIM-type electrical characteristics to drive heat generating members having a bubble jet recording system so as to prevent the nonlinear elements from being destroyed by a heat generation of the nonlinear elements.

According to one aspect of the present invention, there is provided an ink jet recording head comprising heating means each having a heat generating resistor generating a heat energy used for discharging ink and a pair of electrodes connected to the heat generating resistor and nonlinear elements connected in series to the heat generating resistors to drive the heat generating resistors and having MIM-type electrical current and voltage characteristics in which a resistance value at a low voltage is higher than one at a high voltage independently of a polarity, wherein an area of the nonlinear element is larger than that of a portion between the pair of electrodes of the heat generating resistor. This arrangement prevents the nonlinear elements from being destroyed by a heat generation of the nonlinear elements.

Furthermore, preferably the area of the nonlinear element is 3.7 to $10^8$ times larger than that of the portion between the pair of electrodes of the heat generating resistor. This prevents the nonlinear elements themselves from being destroyed by a heat generation thereof and it does not hinder downsizing of the head. Furthermore, it enables a supply of a large current necessary for bubbling a liquid for discharging while lowering a driving voltage to such an extent that it does not increase an element driving cost.

In addition, preferably a length of the nonlinear element in the discharge port arrangement direction is shorter than a length of it in a direction substantially orthogonal to the arrangement direction. This enables the discharge ports and the nonlinear elements to be arranged at a high density.

Furthermore, the arrangement may be such that the nonlinear element is formed on the same PC board as for the heat generating resistor, having a discharge port formed substantially in a direction perpendicular to the PC board and that a flow path extends mainly on the opposite side to a position where the nonlinear element is arranged from the position where the heat generating resistor is formed. Otherwise, the arrangement may be such that the nonlinear element is formed on the same PC board as for the heat generating resistor, having a discharge port formed substantially in a direction parallel to the PC board and that the flow path extends mainly on the same side as the position where the nonlinear element is arranged from the position where the heat generating resistor is formed. In both cases, the nonlinear element having a large area can be arranged without hindering the liquid discharging.

Still further, an arrangement of a cooling structure for the nonlinear element prevents the nonlinear element from being destroyed by a heat generation thereof more reliably.

Preferably, a resistance value of the nonlinear element in a driving state is substantially equal to that of the heat generating resistor.

Furthermore, the present invention may include matrix electrodes constituting a matrix circuit for applying a voltage to the heating means. Additionally, the nonlinear element may be located at an intersection of the matrix electrodes.

An ink jet recording head according to the present invention may have such a mechanism that ink is discharged by causing film boiling in the ink by means of the heat energy.

An ink jet recording apparatus according to the present invention comprises at least an ink jet recording head having one of the above arrangements, being provided with ink discharge ports for discharging ink as opposed to a record area of a recording medium, and feeding means.

DETAILED DESCRIPTION OF THE PREFERRED EMBODIMENTS

The preferred embodiments of the present invention will now be described hereinafter with reference to the accompanying drawings.

First Embodiment

Referring to FIGS. 1, 2, 3, and 4, there are shown a main portion plan view illustrating a first embodiment of the present invention, a graph showing its electrical characteristics, its main portion cross section, and a circuit diagram schematically showing the electrical circuit, respectively.

Figure 1:
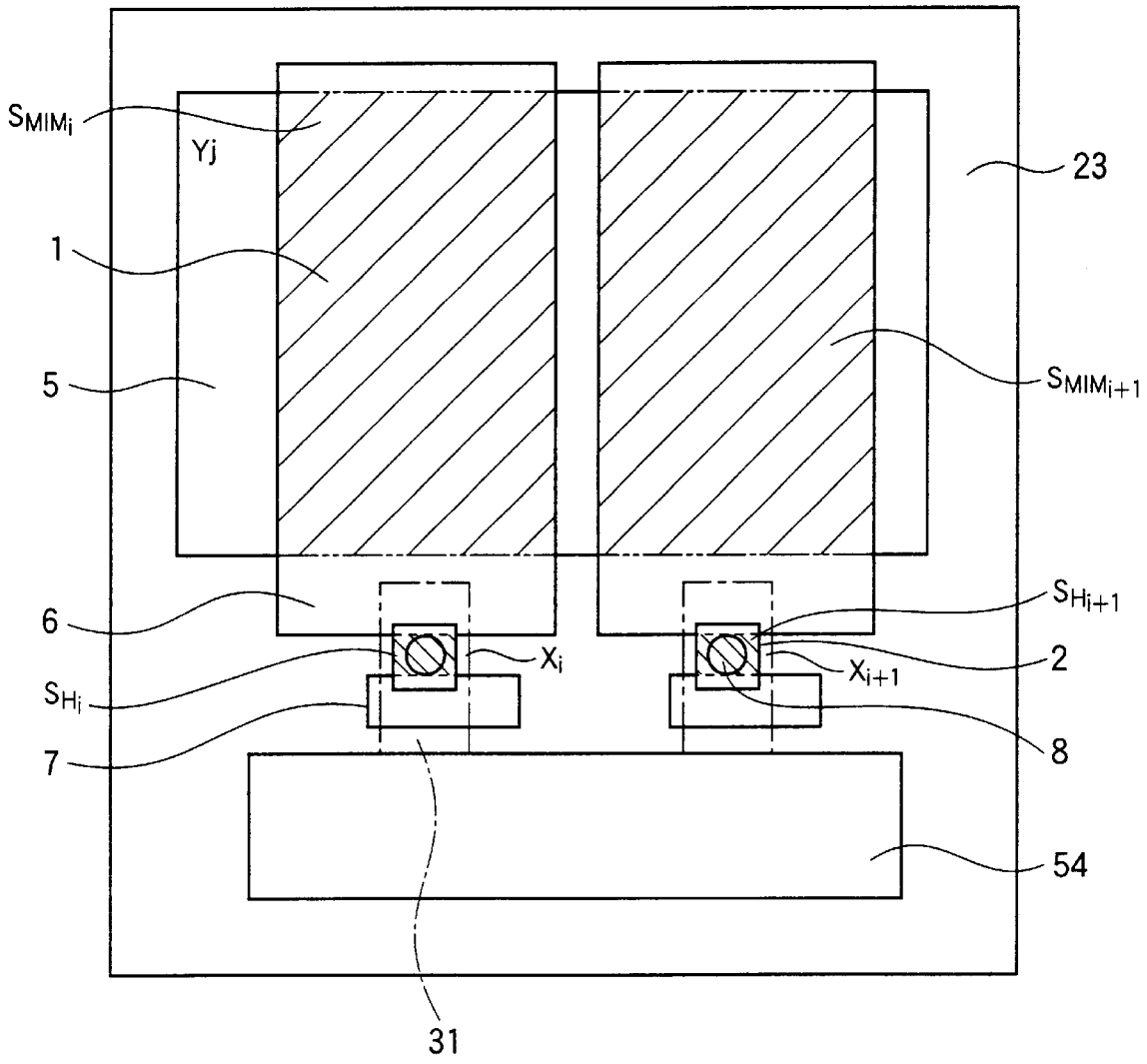
FIG. 1 is a main portion plan view of an ink jet recording head according to a first embodiment of the present invention.
Figure 3:
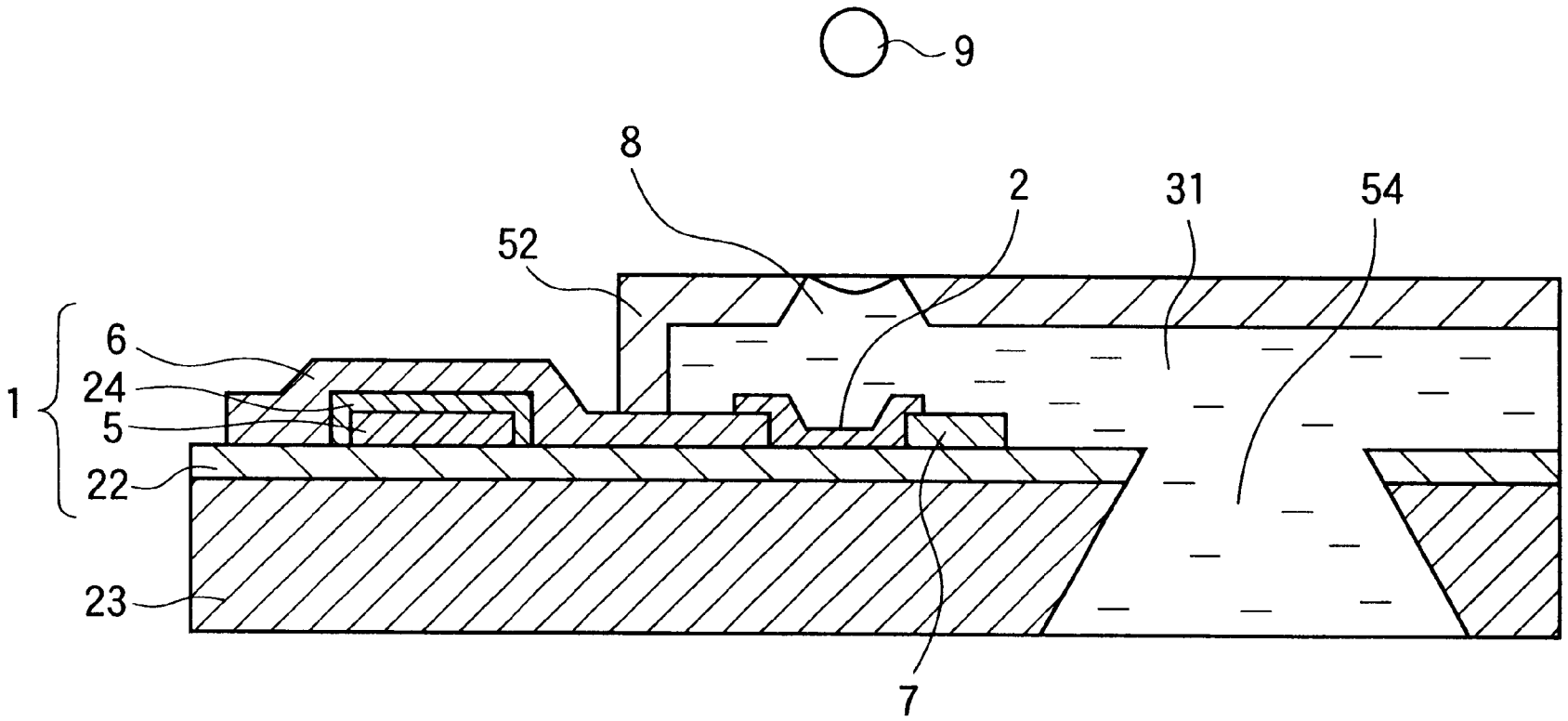
FIG. 3 is a main portion cross section of the ink jet record g head according to the first embodiment.

As shown in FIGS. 1 and 3, an ink jet recording head according to this embodiment has a plurality of striped lower electrodes (vertical electrodes) 5 provided with insulating thin films 24, a plurality of signal electrodes (information electrodes) 7, a plurality of striped upper electrodes (horizontal electrodes) 6 formed on the electrodes, and further a thin film heat generating resistors (heating elements) 2 formed on a PC board 23 having a lower layer (thin film oxide insulating layer) 22. A discharge port formation 52 is arranged on the PC board 23 configured as set forth in the above.

The PC board 23 is made of a thermal good conductor material on which the lower layer 22 is formed. The plurality of lower electrodes 5 are scan electrodes constituting a matrix circuit being coated with an extremely thin insulating film 24. On the other hand, the plurality of upper electrodes 6 are arranged substantially in parallel to the direction crossing the lower electrodes 5 and connected to an end of the heat generating resistor 2. The information electrode 7 is connected to the other end of the heat generating resistor 2 to form the matrix circuit. It should be noted that the discharge port formation 52 is connected to a plurality of flow paths 31 corresponding to the respective heat generating resistors 2. Each flow path 31 has a plurality of discharge ports 8 apertured toward an outside.

In this embodiment, the lower electrode 5, the upper electrode 6, and the insulating thin film 24 therebetween constitute a nonlinear element having MIM type electrical current and voltage characteristics, namely, an MIM element 1. An area of the MIM element 1 is larger than that of the heat generating resistor 2.

Figure 2:
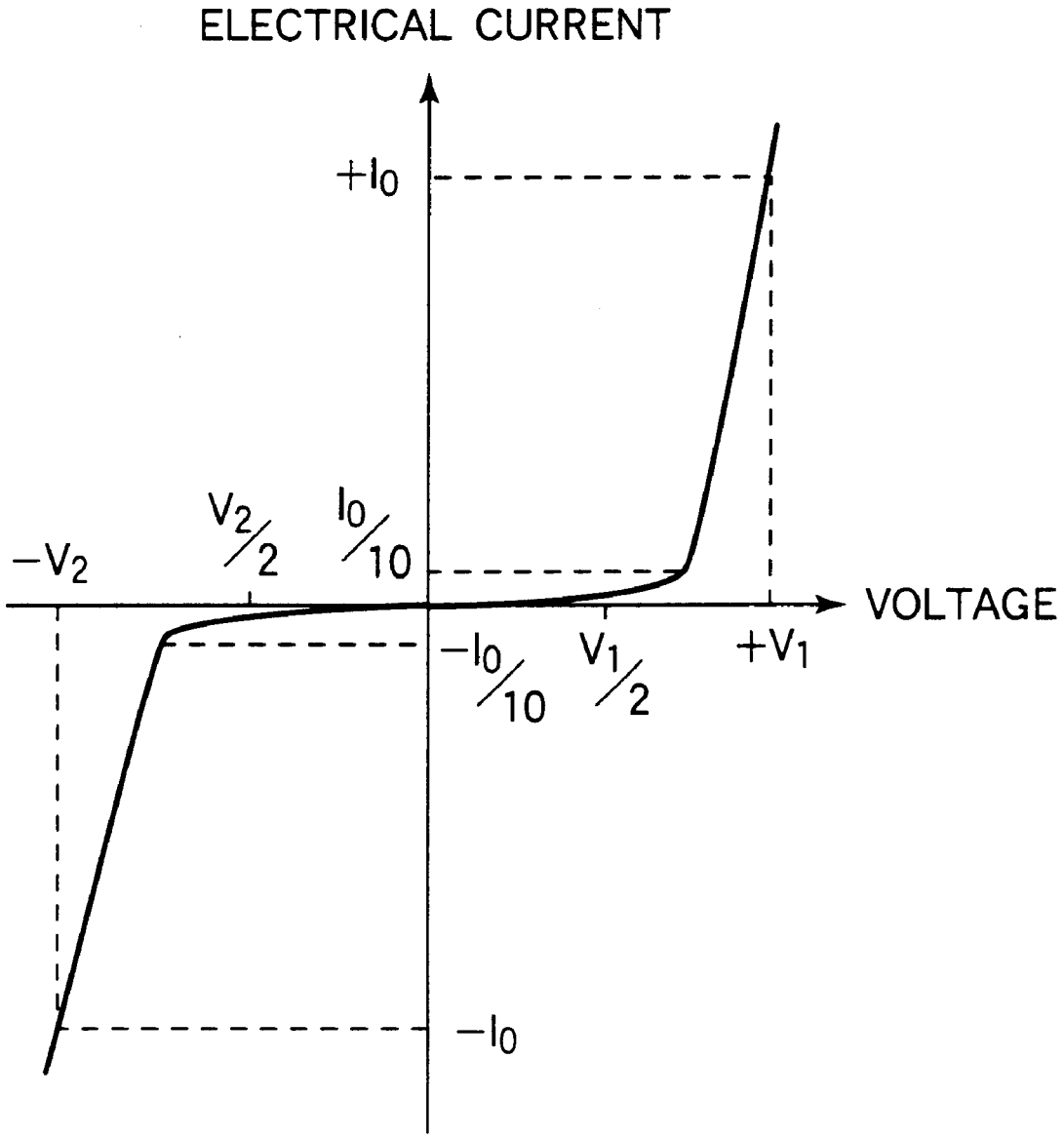
FIG. 2 is an explanatory diagram of an MIM type electrical characteristics.

The term "MIM type electrical characteristics" means electrical current and voltage characteristics indicating a low resistance value on the higher voltage side and a high resistance value on the lower voltage side independently of a polarity as shown in FIG. 2 like those of an MIM element or a varistor. While the MIM element originally means a tunnel junction device having a metal-insulator-metal structure, generally a junction device having a conductor electrode-insulator-conductor electrode structure is also referred to as an MIM element. As a conduction mechanism of an insulator, there are known a hopping electrical conduction in which tunneling is repeated a plurality of number of times in an insulator such as the Poole-Frenkel model conduction and a relatively simple tunnel conduction such as the Fowler-Nordheim model conduction. To cause the tunnel type current to flow so that the current flows into the junction device, a distance between electrodes need be very short. Additionally, it is also possible to use what is called a varistor in which a sintered material layer with metallic oxide additive such as ZnO with Bi, Pr, or Co additive or silicon-carbide (SiC) granulated crystal layer is arranged between electrodes instead of the insulating layer as a nonlinear element in the same manner as for the MIM element and to obtain the MIM type electrical characteristics.

The ink jet recording head according to this embodiment comprises a matrix circuit composed of the lower electrodes 5 and the information electrodes 7, the MIM elements 1 located at intersections of the matrix circuit, and the heat generating resistors 2 connected in series to the MIM elements 1.

As is this configuration, when a voltage is applied to a portion between the lower electrode 5 and the information electrode 7 which are components of the matrix circuit as described later, the MIM element 1 is turned on and power is supplied to the heat generating resistor 2. A heat generation of the heat generating resistor 2 in response to the supplied power rapidly heats a liquid for discharging existing in the flow path 31 supplied from a liquid supplying aperture for discharging 54 thereby causing bubbling, a pressure of the bubbling discharges a droplet 9 from a discharge port 8, and the discharged droplet 9 adheres to a recording medium (not shown), thereby forming an image. Naturally, only at a place (selected point) where a sufficient voltage is applied to the lower electrode 5 and the information electrode 7, the heat generating resistor 2 is heated and the liquid is discharged as described above. At a place (unselected point) where a sufficient voltage is not applied to both of the electrodes 5 and 7, the liquid is not discharged.

The MIM element 1 is arranged at an intersection of both electrodes 5 and 7 which are components of the matrix through the very thin lower layer 22, thereby enabling unnecessary heat generation to be suppressed at a non-discharging point (unselected point) caused by a bias voltage at driving the matrix, by which matrix driving can be applied to the heat generating resistors 2. Furthermore, the matrix driving facilitates an arrangement of a driver (driving means), which is not shown, being separated from the heat generating resistors 2, by which an expensive Si PC board need not be used, thereby enabling a mass production at a low price.

To perform the matrix driving, preferably applied voltages $V_1$ and $-V_2$ for generating a current of a certain equal absolute value $I_0$ satisfy a relation of $0.5<(V_1/V_2)<2$ and an absolute value of a current corresponding to the applied voltages $+V_1/2$ and $-V_2/2$ is $I_0/10$ or lower.

While a threshold value of a film thickness of the insulating thin film 24 which enables a current flow into the MIM element 1, namely, a threshold value of an interval between electrodes 5 and 6 largely depends on a type of the insulating material, that of the electrode material, or a conduction structure, the interval between the electrodes 5 and 6 is preferably 100 nm or shorter in order to cause a significant current to flow for the MIM element 1. Furthermore, to obtain a large current required for the matrix driving of a bubble jet recording head at a low voltage, this interval is preferably 40 nm or shorter. On the other hand, an extremely short interval may cause a field emission of ions on the metal surface of the electrodes 5 and 6 and therefore the interval is preferably 1 nm or longer. To obtain a stable tunnel junction, it is preferably 4 nm or longer. In other words, the interval between the electrodes 5 and 6 is preferably within a range of 1 to 100 nm, and particularly to obtain a large current necessary for matrix driving of the bubble jet recording head at a low voltage, the interval between the electrodes 5 and 6 is preferably within a range of 4 nm to 40 nm.

In this embodiment shown in FIGS. 1 to 4, however, the heat generating resistors 2 are arranged in addition to the MIM elements 1 for liquid heating by means of the heat generating resistors 2. In this embodiment, as shown in FIG. 1, the area of the MIM element 1 is larger than that of the heat generating resistor 2 connected in series thereto and therefore a temperature rise of the MIM element 1 is suppressed even if the heat generating resistor 2 supplies a power of the power density causing bubbling within a certain time period, thereby preventing the MIM element 1 from being destroyed.

Figure 4:
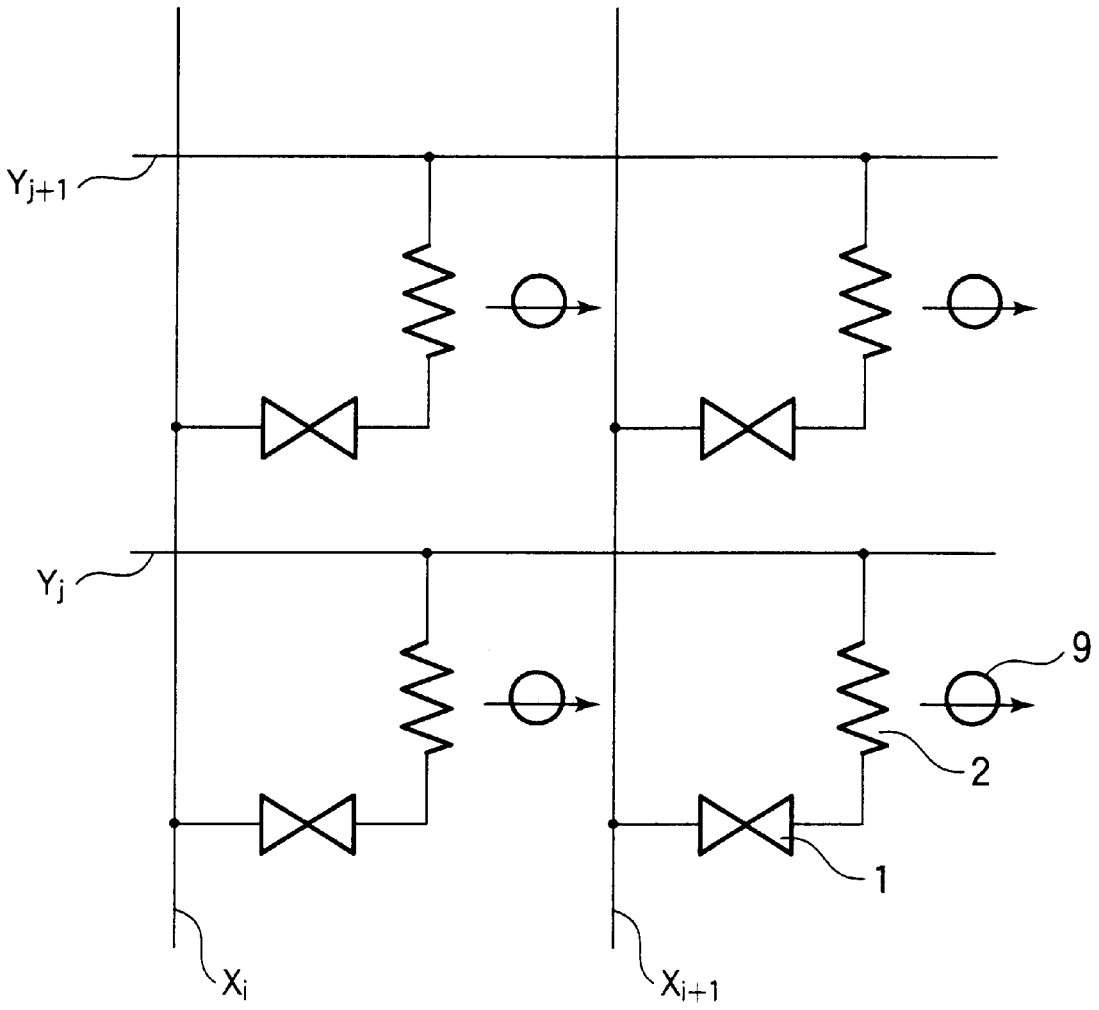
FIG. 4 is an electrical circuit diagram schematically showing the ink jet recording head accord to the first embodiment.

Subsequently, referring to FIG. 4, the matrix circuit of the present invention is described again. FIG. 4 schematically shows the jth and (j+1)th scan electrodes (lower electrodes) $Y_j$ and $Y_{j+1}$ and the ith and (i+1)th information electrodes $X_i$ and $X_{i+1}$. The scan electrodes $Y_j$ and $Y_{j+1}$ and the information electrodes $X_i$ and $X_{i+1}$ constitute the matrix circuit and the MIM element 1 which is a nonlinear element and the heat generating resistor 2 are arranged at intersections of the matrix circuit. In addition, the discharged droplets 9 are also schematically illustrated.

In FIG. 4, the MIM element 1 can be controlled to be turned on or off by inputting a selected potential waveform to the scan electrode and inputting an information potential waveform for discharging or non-discharging according to an image signal to the information electrode. In other words, the MIM element 1 is turned on only under such a condition that it is located at the intersection between the scan electrode to which the selected potential waveform is inputted and the information electrode to which the information potential waveform for discharging is inputted and power is supplied to the heat generating resistor 2 connected in series to it, thereby generating a heat energy between a pair of electrodes connected to the heat generating resistor 2 and discharging the droplets 9. Under other conditions, the MIM element 1 is turned off even if it is performed only one of the input of the selected potential waveform to the scan electrode and the input of the information potential waveform for discharging to the information electrode, thereby not supplying the power to the heat generating resistor 2 connected in series to this and disabling the droplets 9 to be discharged.

As set forth in the above, the larger area the MIM element 1 has in comparison with the area of a portion between a pair of electrodes connected in series to the MIM element 1 (hereinafter, referred to simply as "an area of the heat generating resistor"), the lower becomes the risk of the MIM element 1 destroyed by a heat generation thereof. An area of the MIM element 1 which is too large, however, may make it hard to achieve a fine head. Conventionally judging from a power density at an operation when using the MIM element for a liquid crystal device, the size of the MIM element 1 is preferably equal to or smaller than a value $10^8$ times the size of the heat generating resistor 2 connected in series to the MIM element 1.

In addition, from a viewpoint of achieving a fine head, the smaller area the MIM element 1 has the more preferable. In a bubble jet recording head, however, it is particularly important to pass a large current required for bubbling of a liquid for discharging when the MIM element 1 is in the ON state by increasing a voltage applied to the MIM element 1 to which a large current is supplied to the heat generating resistor 2. To satisfy this requirement and to decrease a driving voltage to prevent an increase of the element driving cost, a resistance value $R_{MIM}$ of the MIM element 1 in the driving state need be substantially equal to a resistance value $R_H$ of the heat generating resistor and preferably $R_{MIM}$ equals $R_H$. In addition, considering that an MIM element 1 having an area $S_{MIM}$ and a heat generating resistor 2 having an area $S_H$ are put side by side in the liquid for discharging including water as the main component, it is preferable to have a relation of $3.7R_{MIM}/S_{MIM}<R_H/S_H$ to cause film boiling by means of the heating element 2 without any occurrence of boiling caused by the MIM element 1 connected in series. The numeral 3.7 as a coefficient in this relation is calculated on assumption that a film boiling temperature of the liquid for discharging including water as the main component is approximately 300° C., a normal boiling temperature is approximately 100° C., and a room temperature is approximately 25° C. As is described above, it is preferable to have a relation $S_{MIM}>3.7S_H$ from the above two conditional expressions. In other words, preferably the area of the nonlinear element 1 is 3.7 to $10^8$ times larger than that of the heat generating resistor 2.

In this embodiment, a length of the discharge port 8 in the arrangement direction is shorter than that of the MIM element 1 in a direction substantially perpendicular to the arrangement direction of the discharge port 8 on the MIM element 1, thereby enabling a high-density arrangement of the discharge ports 8 and the MIM elements 1. Additionally, in this embodiment, the MIM element 1 is formed on the same PC board 23 as for the heat generating resistor 2, the discharge port 8 is formed in a direction substantially perpendicular to the PC board 23, and the flow path 31 extends from the position where the heat generating resistor 2 is formed substantially toward an opposite side of the position mainly where the MIM element 1 is arranged, by which the MIM element 1 having a large area can be arranged so as not to hinder the liquid discharging.

Describing a method of manufacturing the MIM element 1 according to this embodiment, the MIM element 1 has a structure in which striped metal electrodes (upper electrodes) crossing lower electrodes 5 are arranged on an insulating thin film (an oxide insulating film) 24 obtained by anode oxidation of the striped metallic electrodes (lower electrodes) 5. Specifically, the lower electrode 5 has a structure in which a Ta thin film having a thickness of approximately 300 nm is formed by the RF sputtering process and then the surface is oxidized by the anode oxidation coating to form a $Ta_2O_5$ thin film having a thickness of approximately 32 nm. In this formation, the RF sputtering process is performed in an Ar gas atmosphere of approximately $10^{-2}$ Torr. In addition, the anode oxidation coating is performed by using a meshed platinum electrode as a cathode in citric acid solution of 0.8 W/W%. The upper electrode 6 and the information electrode 7 are tantalum thin film electrodes each having a thickness of 23 nm, the PC board 23 is an Si PC board having a thickness of 0.625 mm and a crystallographic axis <111>, the layer 22 beneath the bottom of the lower electrode 5 is an Si thermal oxide film having a thickness of 2.75 $\mu$m, and the heat generating resistor 2 is a tantalum nitride thin film having a thickness of 0.05 $\mu$m.

In this embodiment, the heat generating resistor 2 has a size of 25 $\mu$m ×25 $\mu$m and an area of 625 $\mu m^2$ and its element resistance is 53 Ω. A width of the flow path 31 is 30 $\mu$m and an interval between flow paths is 80 $\mu$m. The MIM element 1 has a size of 84.5 $\mu$m ×20,000 $\mu$m and an area of 1,690,000 $\mu m^2$ and is zonal extending long perpendicularly to the arrangement direction of the discharge port 8. The area of the MIM element 1 is 2,704 times larger than that of the heat generating resistor 2. If a voltage 6.7V is applied to a portion between both ends of the MIM element 1, namely, between the lower electrode 5 and the upper electrode 6, the MIM element resistor is 53 Ω. Therefore, if a voltage 13.4 V is applied to a portion between the lower electrode 5 and the information electrode 7, a voltage 6.7 V is applied to each of the MIM element 1 and the heat generating resistor 2, thereby passing a current of 126 mA. At this point, a power consumption 0.847 W is converted to a heat by the MIM element 1 and the heat generating resistor 2 and a power density of the MIM element 1 is 0.5 $MW/M^2$ and that of the heat generating resistor 2 is 1.355 $GW/m^2$. If a power is supplied to the heat generating resistor 2 under these conditions, the liquid for discharging is heated so as to generate an enough heat to bubble the liquid. In addition, a heat release value per unit area of the MIM element 1 is $1/2{,}704$ of that of the heat generating resistor 2 and therefore a temperature rise can be suppressed. Particularly, the heat retreats to the Si PC board 23 via the lower layer 22, thereby sufficiently enabling a suppression of a temperature rise of the MIM element 1. Furthermore, a resistance value of the MIM element 1 is equal to that of the heat generating resistor 2, thereby supplying a large power to the heat generating resistor 2 and a high operating voltage of the MIM element 1 and thus enabling a large current required for bubbling the liquid for discharging to flow when the MIM element 1 is on.

Second Embodiment

Figure 5:
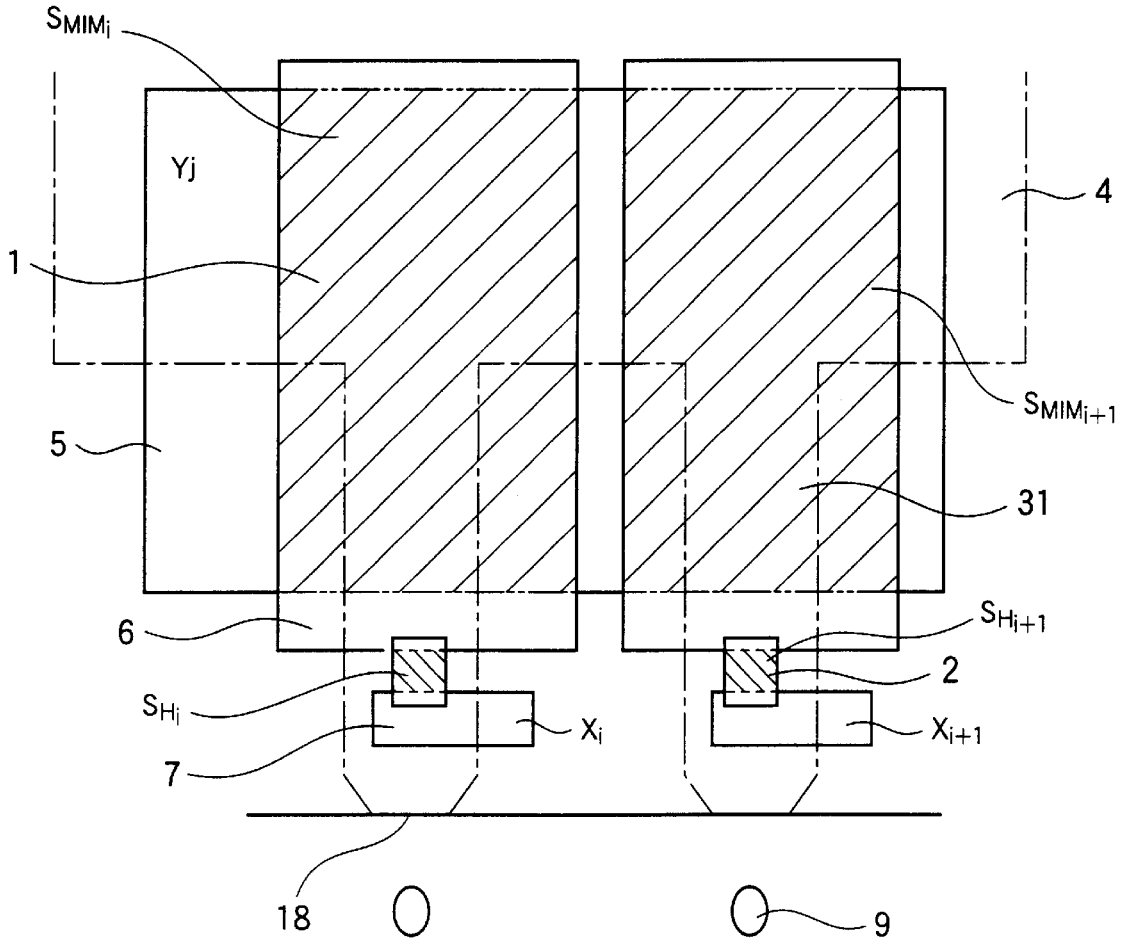
FIG. 5 is a main portion plan view of an ink jet recording head according to a second embodiment of the present invention.

Referring to FIG. 5, there is shown a main portion of an ink jet recording head according to a second embodiment of the present invention. The same portions as for the first embodiment are given the same reference numerals and their explanation is omitted here.

In this embodiment, an MIM element 1 is formed on the same PC board 23 as for a heat generating resistor 2, with an discharge port 18 formed in a direction substantially parallel to the PC board 23. A flow path 19 extends from a formation of the heat generating resistor 2 mainly toward an arrangement position side of the MIM element 1. Therefore, the MIM element 1 having a large area does not hinder liquid discharging. In addition, a part of the MIM element 1 is thermally in contact with the liquid for discharging, thereby enabling a heat generated by the MIM element 1 to retreat to the liquid for discharging, by which a temperature rise of the MIM element can be prevented effectively.

Third Embodiment

Figure 6:
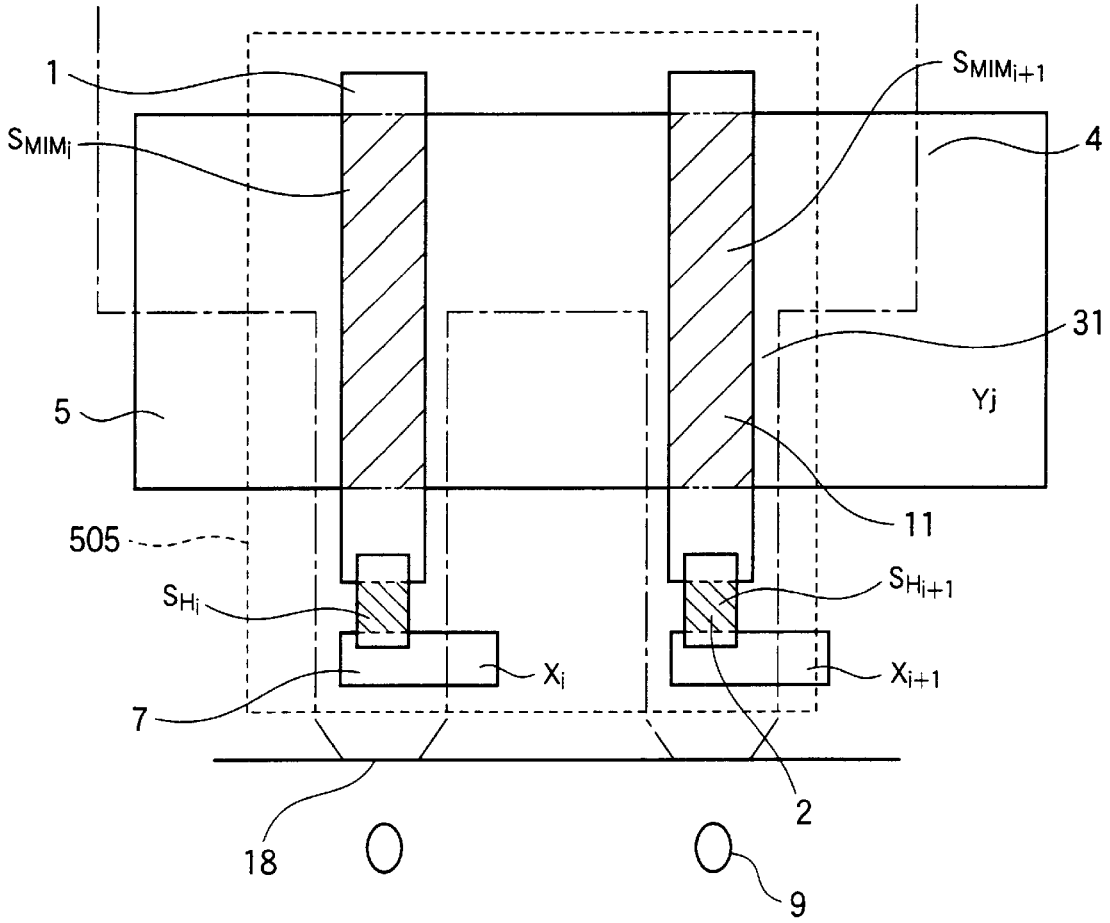
FIG. 6 is a main portion plan view of an ink jet recording head according to a third embodiment of the present invention.

Referring to FIG. 6, there is shown a main portion of an ink jet recording head according to a third embodiment of the present invention. The same portions as for the first and second embodiments are given the same reference numerals and their explanation is omitted here.

In this embodiment, there is arranged an MIM element 1 entirely in contact with a liquid for discharging via a thin film layer. An $SiO_2$ thin film having a thickness of 0.6 $\mu$m and a thermal diffusivity κ of 0.47 $mm^2/s$ is formed on an MIM element 1 and a heat generating resistor 2 by the sputtering deposition; the $SiO_2$ thin film is a protective coat 505 of the MIM element 1 and the heat generating resistor 2. By being protected by the protective coat 505, the MIM element 11 can be arranged in a liquid chamber 4 and the flow path 31 or being adjacent to them. Accordingly, an area of the MIM element 11 can be reduced without enlarging an ink jet recording head.

For example, when a droplet 9 is discharged by applying a voltage in pulses at 2 $\mu$s to a portion between a lower electrode 5 and an upper electrode 6, a heat conducting distance of the protective coat 505, namely, the square root of $\kappa\Delta t$ multiplied by 2 is 1.94 $\mu$m. A thickness of the protective coat 505 is less than the heat conducting distance, thereby diffusing the heat generated by the MIM element 11 quickly to the liquid for discharging when the voltage for discharging is applied and enabling a suppression of a temperature rise of the MIM element 11 and a protection thereof.

Describing a method of manufacturing the MIM element 1 according to this embodiment in the same manner as for the first embodiment, the MIM element 1 has a structure in which a striped metallic electrode (upper electrode) 6 crossing a lower electrode 5 is arranged on an insulating thin film (oxide insulating film) 24 obtained by anode oxidation of the striped metallic electrode (lower electrode) 5. Specifically, the lower electrode 5 is made by forming a Ta thin film having a thickness of approximately 300 nm by the RF sputtering process and then oxidizing its surface by the anode oxidation coating to form a $Ta_2O_5$ thin film having a thickness of approximately 32 nm. In this formation, the RF sputtering process is performed in an Ar gas atmosphere of approximately $10^{-2}$ Torr. In addition, the anode oxidation coating is performed by using a meshed platinum electrode as a cathode in citric acid solution of 0.8 W/W%. The upper electrode 6 and the information electrode 7 are tantalum thin film electrodes each having a thickness of 23 nm, the PC board 23 is a Si PC board having a thickness of 0.625 mm and a crystallographic axis <111>, the layer 22 beneath the bottom of the lower electrode 5 is an Si thermal oxide film having a thickness of 2.75 $\mu$m, and the heat generating resistor 2 is a tantalum nitride thin film having a thickness of 0.05 $\mu$m.

In this embodiment, the heat generating resistor 2 has a size of 40 $\mu$m ×40 $\mu$m and an area of 1,600 $\mu m^2$ and its element resistance is 53 Å. A width of the flow path 31 is 30 $\mu$m and an interval between flow paths is 80 $\mu$m. The MIM element 11 has a size of 42.25 $\mu$m ×40,000 $\mu$m and an area of 1,690,000 $\mu m^2$ and is zonal extending long perpendicularly to the arrangement direction of the discharge port 8. The area of the MIM element 11 is 1,056 times larger than that of the heat generating resistor 2. If a voltage 6.7V is applied to a portion between both ends of the MIM element 11, namely, between the lower electrode 5 and the upper electrode 6, the MIM element resistor is 53Å. Therefore, if a voltage 13.4V is applied to a portion between the lower electrode 5 and the information electrode 7, a voltage 6.7V is applied to each of the MIM element 11 and the heat generating resistor 2, thereby passing a current of 126 mA. At this point, a power consumption 0.847 W is converted to a heat by the MIM element 11 and the heat generating resistor 2 and a power density of the MIM element 11 is 0.5 $MW/M^2$ and that of the heat generating resistor 2 is 0.529 $GW/m^2$. If a power is supplied to the heat generating resistor 2 under these conditions, the liquid for discharging is heated so as to generate an enough heat to bubble the liquid. In addition, a heat release value per unit area of the MIM element 11 is 1/1,056 of that of the heat generating resistor 2 and therefore a temperature rise can be suppressed.

Furthermore, condition $3.7R_{MIM}/S_{MIM}<R_H/S_H$ is satisfied, by which there is no fear of an unstable discharging caused by a generation of bubbles including water as the main component, which had not been considered at designing the MIM element 11.

In this embodiment, the MIM element 11 is arranged being adjacent to the liquid for discharging, thereby working as a heat dissipation structure, namely, a cooling structure. Specifically, the MIM element 11 has a protective coat 505 having a thermal diffusivity $\kappa$ in contact with the electrode and a thickness of the protective film 505 is less than a value of the square root of $\kappa\Delta t$ multiplied by 2 when a pulse voltage for a time period $\Delta t$ is applied to the MIM element 11. This prevents the MIM element 11 from being destroyed by a heat generation thereof.

Figure 7:
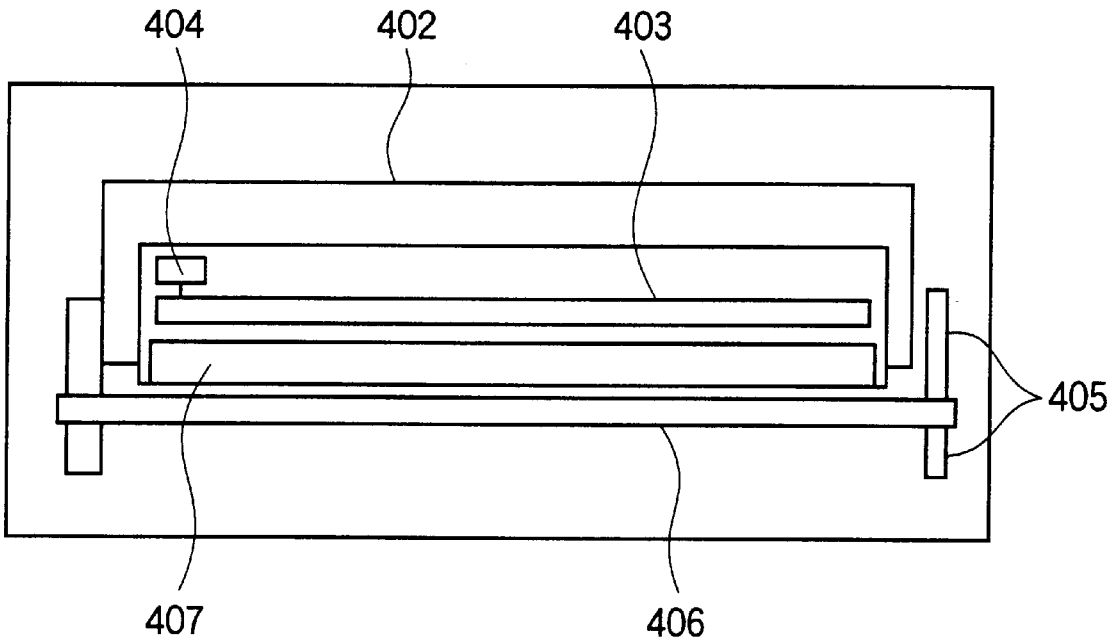
FIG. 7 is a schematic view showing an example of an ink jet recording apparatus of the present invention on which the ink jet recording head of the present invention is mounted.

Subsequently, referring to FIG. 7, there is shown a schematic view showing an example of an ink jet recording apparatus on which the ink jet recording head described in the above embodiments is mounted.

This ink jet recording apparatus has a mechanism in which paper 406 which is a recording medium is fed by a paper feeding roller 405 whose driving is controlled by a driver 403. An ink jet recording head 407 controlled by a control unit 404 has respective discharge ports so as to be opposed to the fed paper 406 and controls discharging or non-discharging of droplets 9 discharged from the discharge ports 8 by controlling the on or off state of nonlinear elements 1 according to signals from the control unit 404. As set forth in the above, ink on the heat generating resistors 2 to which power is supplied is rapidly heated, by which bubbles based on a film boiling phenomenon are generated at a time over the entire surface of the heat generating resistors 2 together with an extremely high pressure. This pressure discharges the droplets 9 from the discharge ports 8 as set forth in the above, by which an image is formed on the recording medium. Furthermore, ink is supplied from an ink tank 402 to the ink jet recording head 407 together with the discharging of the droplets 9.

What is claimed is:

1. An ink jet recording head comprising:

heating means including a plurality of heat generating resistors generating heat energy used for discharging ink;

a pair of electrodes connected to each of said heat generating resistors; and a nonlinear element connected in series to each of said heat generating resistors to drive said respective heat generating resistor, said nonlinear element having MIM-type electrical current and voltage characteristics such that a resistance value at a low voltage is higher than a resistance value at a high voltage, independently of polarity, wherein an area of each of said nonlinear elements is larger than an area of a portion between said respective pair of electrodes connected to said respective heat generating resistor.

2. The head according to claim 1, wherein said area of each of said nonlinear elements is 3.7 to $10^8$ times larger than said area of said portion between said respective pair of electrodes connected to said respective heat generating resistor.

3. The head according to claim 2, wherein a resistance value of each nonlinear element in a driving state is substantially equal to that of said respective heat generating resistor.

4. The head according to claim 1, wherein a length of each nonlinear element in a discharge port arrangement direction is shorter than a length of it in a direction substantially orthogonal to the discharge port arrangement direction.

5. The head according to claim 1, further comprising:

a PC board on which said nonlinear elements and said heat generating resistors are formed; and a discharge port for discharging ink in a flow path formed correspondingly to each of said heat generating resistors, said discharge port being formed substantially in a direction perpendicular to said PC board, wherein said flow path extends mainly from a position adjacent to said respective heat generating resistor in a direction away from said respective nonlinear element.

6. The head according to claim 1, further comprising:

a PC board on which said nonlinear elements and said heat generating resistors are formed; and a discharge port for discharging ink in a flow path formed correspondingly to each of said heat generating resistors, said discharge port being formed substantially in a direction parallel to said PC board, wherein said flow path extends mainly from a position adjacent to said respective heat generating resistor in a direction toward said respective nonlinear element.

7. The head according to claim 1, further comprising a cooling structure for each nonlinear element.

8. The head according to claim 1, wherein a resistance value of each nonlinear element in a driving state is substantially equal to that of said respective heat generating resistor.

9. The head according to claim 1, further comprising matrix electrodes constituting a matrix circuit for applying a voltage to said heating means.

10. The head according to claim 9, wherein each nonlinear element is arranged at an intersection of said matrix electrodes.

11. The head according to claim 1, wherein the ink is discharged by causing film boiling in the ink by means of the heat energy.

12. An ink jet recording apparatus, comprising the ink jet recording head according to claim 1 and feeding means for feeding a recording medium, wherein said head has ink discharge ports for discharging the ink arranged correspondingly to said heat generating resistors.

* * * * *

UNITED STATES PATENT AND TRADEMARK OFFICE

CERTIFICATE OF CORRECTION

PATENT NO. : 6,499,833 B2
DATED : December 31, 2002
INVENTOR(S) : Hideyuki Sugioka It is certified that error appears in the above-identified patent and that said Letters Patent is hereby corrected as shown below:

Column 3,
Line 47, “record” should read -- record- --;
Line 48, “g” (first occurrence) should read -- ing --; and
Line 50, “accord” should read -- according --.

Signed and Sealed this

Twenty-third Day of September, 2003

JAMES E. ROGAN
*Director of the United States Patent and Trademark Office*